US010132122B2

(12) United States Patent
Ricks et al.

(10) Patent No.: US 10,132,122 B2
(45) Date of Patent: Nov. 20, 2018

(54) EARTH-BORING ROTARY TOOLS HAVING FIXED BLADES AND ROLLING CUTTER LEGS, AND METHODS OF FORMING SAME

(71) Applicant: Baker Hughes Incorporated, Houston, TX (US)

(72) Inventors: Gregory L. Ricks, Spring, TX (US); Floyd C. Felderhoff, Montgomery, TX (US); Rudolf Carl Pessier, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 15/131,440

(22) Filed: Apr. 18, 2016

(65) Prior Publication Data

US 2016/0230468 A1 Aug. 11, 2016
US 2018/0266184 A9 Sep. 20, 2018

Related U.S. Application Data

(63) Continuation of application No. 14/665,403, filed on Mar. 23, 2015, now Pat. No. 9,476,259, which is a
(Continued)

(51) Int. Cl.
*E21B 10/62* (2006.01)
*E21B 10/14* (2006.01)
(Continued)

(52) U.S. Cl.
CPC ..... *E21B 10/62* (2013.01); *E21B 10/14* (2013.01); *E21B 10/16* (2013.01); *E21B 10/20* (2013.01)

(58) Field of Classification Search
CPC ..... E21B 10/20; E21B 10/62; E21B 10/633; E21B 2010/62
See application file for complete search history.

(56) References Cited

U.S. PATENT DOCUMENTS 930,759 A 8/1909 Hughes
1,388,424 A 8/1921 George
(Continued)

FOREIGN PATENT DOCUMENTS

DE 1301784 8/1969
EP 0225101 6/1987
(Continued)

OTHER PUBLICATIONS

Buske, et al., "Performance Paradigm Shift: Drilling Vertical and Directional Sections Through Abrasive Formations with Roller Cone Bits", Society of Petroleum Engineers—SPE 114975, CIPC/SPE Gas Technology Symposium 2008, Joint Conference, Canada, Jun. 16-19, 2008.
(Continued)

*Primary Examiner* — Jennifer H Gay
(74) *Attorney, Agent, or Firm* — TraskBritt

(57) ABSTRACT

An earth-boring rotary tool includes a tool body, at least one fixed blade associated with the tool body and configured to carry a fixed cutting element, and at least one leg configured to carry a rolling cutter. The tool body has a slot extending longitudinally generally parallel to a longitudinal axis defining an axial center of the tool body. The slot is at least partially defined by a first sidewall, a second sidewall opposing the first sidewall, a third sidewall extending between the first sidewall and the second sidewall, and an axial end wall of the tool body. A portion of the leg is disposed within the slot of the tool body and abuts the first sidewall of the tool body. A wedge is disposed within the slot and pins the leg to the tool body within the slot.

20 Claims, 8 Drawing Sheets

Related U.S. Application Data continuation of application No. 13/367,526, filed on Feb. 7, 2012, now abandoned.

(60) Provisional application No. 61/441,907, filed on Feb. 11, 2011.

(51) Int. Cl.
*E21B 10/20* (2006.01)
*E21B 10/16* (2006.01)

(56) References Cited

U.S. PATENT DOCUMENTS 1,394,769 A 10/1921 Sorensen
1,519,641 A 12/1924 Thompson
1,537,550 A 5/1925 Reed
1,729,062 A 9/1929 Bull
1,801,720 A 4/1931 Bull
1,816,568 A 7/1931 Carlson
1,821,474 A 9/1931 Mercer
1,874,066 A 8/1932 Scott et al.
1,879,127 A 9/1932 Schlumpf
1,896,243 A 2/1933 MacDonald
1,932,487 A 10/1933 Scott
2,030,722 A 2/1936 Scott
2,089,187 A 8/1937 Camille et al.
2,117,481 A 5/1938 Howard et al.
2,119,618 A 6/1938 Zublin
2,126,036 A 8/1938 Reed
2,184,067 A 12/1939 Zublin
2,198,849 A 4/1940 Waxier
2,204,657 A 6/1940 Clyde
2,216,894 A * 10/1940 Stancliff ..... E21B 10/10 175/340
2,244,537 A 6/1941 Kammerer
2,288,433 A 6/1942 Nielsen et al.
2,297,157 A 9/1942 McClinton
2,318,370 A * 5/1943 Burch ..... E21B 10/16 175/339
2,320,136 A 5/1943 Kammerer
2,320,137 A 5/1943 Kammerer
2,358,642 A 9/1944 Kammerer
2,380,112 A 7/1945 Kinnear
2,520,517 A 8/1950 Taylor
2,533,258 A 12/1950 Morlan et al.
2,533,259 A 12/1950 Woods et al.
2,557,302 A 6/1951 Maydew
RE23,416 E 10/1951 Kinnear
2,575,438 A * 11/1951 Alexander ..... E21B 10/58 175/418
2,628,821 A * 2/1953 Alexander ..... E21B 10/58 175/418
2,661,931 A 12/1953 Swart
2,719,026 A 9/1955 Boice
2,725,215 A 11/1955 MacNeir
2,807,444 A 9/1957 Reifschneider
2,815,932 A 12/1957 Wolfram
2,994,389 A 8/1961 Bus, Sr.
3,010,708 A 11/1961 Hlinsky et al.
3,039,503 A 6/1962 Mainone
3,050,293 A 8/1962 Hlinsky
3,055,443 A 9/1962 Edwards
3,066,749 A 12/1962 Hildebrandt
3,126,066 A 3/1964 Williams, Jr.
3,126,067 A 3/1964 Schumacher, Jr.
3,174,564 A 3/1965 Morlan
3,239,431 A 3/1966 Raymond
3,250,337 A 5/1966 Demo
3,269,469 A 8/1966 Kelly, Jr.
3,294,186 A 12/1966 Buell
3,387,673 A 6/1968 Thompson
3,397,751 A 8/1968 Reichmuth
3,424,258 A 1/1969 Reichmuth
3,583,501 A 6/1971 Aalund
3,760,894 A 9/1973 Pitifer
3,907,191 A 9/1975 Lichte
RE28,625 E 11/1975 Cunningham
4,006,788 A 2/1977 Gamer
4,108,259 A 8/1978 Dixon et al.
4,140,189 A 2/1979 Gamer
4,153,832 A 5/1979 Iio et al.
4,187,922 A 2/1980 Phelps
4,190,126 A 2/1980 Kabashima
4,190,301 A 2/1980 Lachonius et al.
4,229,638 A 10/1980 Lichte
4,260,203 A 4/1981 Gamer
4,270,812 A 6/1981 Thomas
4,285,409 A 8/1981 Allen
4,293,048 A 10/1981 Kloesel, Jr.
4,314,132 A 2/1982 Porter
4,320,808 A 3/1982 Garrett
4,343,371 A 8/1982 Baker, III et al.
4,359,112 A 11/1982 Gamer et al.
4,359,114 A 11/1982 Miller et al.
4,369,849 A 1/1983 Parrish
4,386,669 A 6/1983 Evans
4,408,671 A 10/1983 Munson
4,410,284 A 10/1983 Herrick
4,417,629 A 11/1983 Wallace
4,428,687 A 1/1984 Zahradnik
4,444,281 A 4/1984 Schumacher, Jr. et al.
4,448,269 A 5/1984 Ishikawa et al.
4,456,082 A 6/1984 Harrison
4,468,138 A 8/1984 Nagel
4,527,637 A 7/1985 Bodine
4,527,644 A 7/1985 Allam
4,572,306 A 2/1986 Dorosz
4,600,064 A 7/1986 Scales et al.
4,627,882 A 12/1986 Soderstrom
4,641,718 A 2/1987 Bengtsson
4,657,091 A 4/1987 Higdon
4,664,705 A 5/1987 Horton et al.
4,690,228 A 9/1987 Voelz et al.
4,706,765 A 11/1987 Lee et al.
4,726,718 A 2/1988 Meskin et al.
4,727,942 A 3/1988 Galle et al.
4,729,440 A 3/1988 Hall
4,738,322 A 4/1988 Hall et al.
4,756,631 A 7/1988 Jones
4,763,736 A 8/1988 Varel, Sr.
4,765,205 A 8/1988 Higdon
4,802,539 A 2/1989 Hall et al.
4,819,703 A 4/1989 Rice et al.
4,825,964 A 5/1989 Rives
4,865,137 A 9/1989 Bailey et al.
4,874,047 A 10/1989 Hixon
4,875,532 A 10/1989 Langford, Jr.
4,880,068 A 11/1989 Bronson
4,892,159 A 1/1990 Holster
4,892,420 A 1/1990 Kruger
4,915,181 A 4/1990 Labrosse
4,932,484 A 6/1990 Warren et al.
4,936,398 A 6/1990 Auty et al.
4,943,488 A 7/1990 Sung et al.
4,953,641 A 9/1990 Pessier
4,976,324 A 12/1990 Tibbitts
4,981,184 A 1/1991 Knowlton et al.
4,984,643 A 1/1991 Isbell et al.
4,991,671 A 2/1991 Pearce et al.
5,016,718 A 5/1991 Tandberg
5,027,912 A 7/1991 Juergens
5,027,914 A 7/1991 Wilson
5,028,177 A 7/1991 Meskin et al.
5,030,276 A 7/1991 Sung et al.
5,037,212 A 8/1991 Justman et al.
5,049,164 A 9/1991 Horton et al.
5,092,687 A 3/1992 Hall
5,116,568 A 5/1992 Sung et al.
5,137,097 A 8/1992 Fernandez
5,145,017 A 9/1992 Holster et al.
5,166,495 A 11/1992 Ekeloef et al.
5,176,212 A 1/1993 Tandberg
5,199,516 A 4/1993 Fernandez

(56) References Cited

U.S. PATENT DOCUMENTS 5,224,560 A 7/1993 Fernandez
5,238,074 A 8/1993 Tibbitts et al.
5,253,939 A 10/1993 Hall
5,287,936 A 2/1994 Grimes et al.
5,289,889 A 3/1994 Gearhart et al.
5,337,843 A 8/1994 Torgrimsen et al.
5,342,129 A 8/1994 Dennis et al.
5,346,026 A 9/1994 Pessier et al.
5,351,770 A 10/1994 Cawthorne et al.
5,361,859 A 11/1994 Tibbitts
5,429,200 A 7/1995 Blackman et al.
5,439,067 A 8/1995 Huffstutler
5,439,068 A 8/1995 Huffstutler et al.
5,452,770 A 9/1995 Millsapps, Jr.
5,452,771 A 9/1995 Blackman et al.
5,467,836 A 11/1995 Grimes et al.
5,472,057 A 12/1995 Winfree
5,472,271 A 12/1995 Bowers et al.
5,494,123 A 2/1996 Nguyen
5,513,715 A 5/1996 Dysart
5,518,077 A 5/1996 Blackman et al.
D372,253 S 7/1996 Huffstutler et al.
5,531,281 A 7/1996 Murdock
5,532,454 A 7/1996 Kuhnen
5,547,033 A 8/1996 Campos, Jr.
5,553,681 A 9/1996 Huffstutler et al.
5,558,170 A 9/1996 Thigpen et al.
5,560,440 A 10/1996 Tibbitts
5,570,750 A 11/1996 Williams
5,593,231 A 1/1997 Ippolito
5,595,255 A 1/1997 Huffstutler
5,606,895 A 3/1997 Huffstutler
5,624,002 A 4/1997 Huffstutler
5,641,029 A 6/1997 Beaton et al.
5,644,956 A 7/1997 Blackman et al.
5,655,612 A 8/1997 Grimes et al.
D384,084 S 9/1997 Huffstutler et al.
5,672,286 A 9/1997 Seeds
5,695,018 A 12/1997 Pessier et al.
5,695,019 A 12/1997 Shamburger, Jr.
5,755,297 A 5/1998 Young et al.
5,839,525 A 11/1998 Hoffmaster et al.
5,839,526 A 11/1998 Cisneros et al.
5,862,871 A 1/1999 Curlett
5,868,502 A 2/1999 Cariveau et al.
5,873,422 A 2/1999 Hansen et al.
5,941,322 A 8/1999 Stephenson et al.
5,944,125 A 8/1999 Byrd
5,967,246 A 10/1999 Caraway et al.
5,979,576 A 11/1999 Hansen et al.
5,988,303 A 11/1999 Arfele
5,992,542 A 11/1999 Rives
5,996,713 A 12/1999 Pessier et al.
6,045,029 A 4/2000 Scott
6,068,070 A 5/2000 Scott
6,092,613 A 7/2000 Caraway et al.
6,095,265 A 8/2000 Alsup
6,109,375 A 8/2000 Tso
6,116,357 A 9/2000 Wagoner et al.
6,170,582 B1 1/2001 Singh et al.
6,173,797 B1 1/2001 Dykstra et al.
6,190,050 B1 2/2001 Campbell
6,209,185 B1 4/2001 Scott
6,220,374 B1 4/2001 Crawford
6,241,034 B1 6/2001 Steinke et al.
6,241,036 B1 6/2001 Lovato et al.
6,250,407 B1 6/2001 Karlsson
6,260,635 B1 7/2001 Crawford
6,279,671 B1 8/2001 Panigrahi et al.
6,283,233 B1 9/2001 Lamine et al.
6,296,069 B1 10/2001 Lamine et al.
RE37,450 E 11/2001 Deken et al.
6,345,673 B1 2/2002 Siracki
6,360,831 B1 3/2002 Akesson et al.
6,367,568 B2 4/2002 Steinke et al.
6,386,302 B1 5/2002 Beaton
6,401,844 B1 6/2002 Doster et al.
6,405,811 B1 6/2002 Borchardt
6,408,958 B1 6/2002 Isbell et al.
6,415,687 B2 7/2002 Saxman
6,427,791 B1 8/2002 Glowka et al.
6,427,798 B1 8/2002 Imashige
6,439,326 B1 8/2002 Huang et al.
6,446,739 B1 9/2002 Richman et al.
6,450,270 B1 9/2002 Saxton
6,460,635 B1 10/2002 Kalsi et al.
6,474,424 B1 11/2002 Saxman
6,510,906 B1 1/2003 Richert et al.
6,510,909 B2 1/2003 Portwood et al.
6,527,066 B1 3/2003 Rives
6,533,051 B1 3/2003 Singh et al.
6,544,308 B2 4/2003 Griffin et al.
6,561,291 B2 5/2003 Xiang
6,562,462 B2 5/2003 Griffin et al.
6,568,490 B1 5/2003 Tso et al.
6,581,700 B2 6/2003 Curlett et al.
6,585,064 B2 7/2003 Griffin et al.
6,589,640 B2 7/2003 Griffin et al.
6,592,985 B2 7/2003 Griffin et al.
6,601,661 B2 8/2003 Baker et al.
6,601,662 B2 8/2003 Matthias et al.
6,637,528 B2 10/2003 Nishiyama et al.
6,684,966 B2 2/2004 Lin et al.
6,684,967 B2 2/2004 Mensa-Wilmot et al.
6,729,418 B2 5/2004 Slaughter, Jr. et al.
6,739,214 B2 5/2004 Griffin et al.
6,742,607 B2 6/2004 Beaton
6,745,858 B1 6/2004 Estes
6,749,033 B2 6/2004 Griffin et al.
6,797,326 B2 9/2004 Griffin et al.
6,823,951 B2 11/2004 Yang et al.
6,843,333 B2 1/2005 Richert et al.
6,861,098 B2 3/2005 Griffin et al.
6,861,137 B2 3/2005 Griffin et al.
6,878,447 B2 4/2005 Griffin et al.
6,883,623 B2 4/2005 McCormick et al.
6,902,014 B1 6/2005 Estes
6,922,925 B2 8/2005 Watanabe et al.
6,986,395 B2 1/2006 Chen
6,988,569 B2 1/2006 Lockstedt et al.
7,096,978 B2 8/2006 Dykstra et al.
7,111,694 B2 9/2006 Beaton
7,128,173 B2 10/2006 Lin
7,137,460 B2 11/2006 Slaughter, Jr. et al.
7,152,702 B1 12/2006 Bhome et al.
7,197,806 B2 4/2007 Boudreaux et al.
7,198,119 B1 4/2007 Hall et al.
7,234,549 B2 6/2007 McDonough et al.
7,234,550 B2 6/2007 Azar et al.
7,270,196 B2 9/2007 Hall
7,281,592 B2 10/2007 Runia et al.
7,292,967 B2 11/2007 McDonough et al.
7,311,159 B2 12/2007 Lin et al.
7,320,375 B2 1/2008 Singh
7,341,119 B2 3/2008 Singh et al.
7,350,568 B2 4/2008 Mandal et al.
7,350,601 B2 4/2008 Belnap et al.
7,360,612 B2 4/2008 Chen et al.
7,377,341 B2 5/2008 Middlemiss et al.
7,387,177 B2 6/2008 Zahradnik et al.
7,392,862 B2 7/2008 Zahradnik et al.
7,398,837 B2 7/2008 Hall et al.
7,416,036 B2 8/2008 Forstner et al.
7,435,478 B2 10/2008 Keshavan
7,458,430 B2 12/2008 Fyfe
7,462,003 B2 12/2008 Middlemiss
7,473,287 B2 1/2009 Belnap et al.
7,493,973 B2 2/2009 Keshavan et al.
7,517,589 B2 4/2009 Eyre
7,533,740 B2 5/2009 Zhang et al.
7,559,695 B2 7/2009 Sexton et al.
7,568,534 B2 8/2009 Griffin et al.
7,621,346 B1 11/2009 Trinh et al.
7,621,348 B2 11/2009 Hoffmaster et al.

(56) References Cited

U.S. PATENT DOCUMENTS

| | | | | |
|---|---|---|---|---|
| 7,647,991 | B2 | 1/2010 | Felderhoff et al. | |
| 7,703,556 | B2 | 4/2010 | Smith et al. | |
| 7,703,557 | B2 | 4/2010 | Durairajan et al. | |
| 7,819,208 | B2 | 10/2010 | Pessier et al. | |
| 7,836,975 | B2 | 11/2010 | Chen et al. | |
| 7,845,435 | B2 | 12/2010 | Zahradnik et al. | |
| 7,845,437 | B2 | 12/2010 | Bielawa et al. | |
| 7,847,437 | B2 | 12/2010 | Chakrabarti et al. | |
| 7,992,658 | B2 | 8/2011 | Buske | |
| 8,028,769 | B2 | 10/2011 | Pessier et al. | |
| 8,056,651 | B2 | 11/2011 | Turner et al. | |
| 8,177,000 | B2 | 5/2012 | Bhome et al. | |
| 8,201,646 | B2 | 6/2012 | Vezirian | |
| 8,302,709 | B2 | 11/2012 | Bhome et al. | |
| 8,356,398 | B2 | 1/2013 | McCormick et al. | |
| 8,448,724 | B2 * | 5/2013 | Buske | E21B 7/28 175/336 |
| 8,950,514 | B2 | 2/2015 | Buske et al. | |
| 9,381,600 | B2 | 7/2016 | Roth | |
| 9,476,259 | B2 * | 10/2016 | Ricks | E21B 10/14 |
| 9,782,857 | B2 * | 10/2017 | Nguyen | B23K 31/02 |
| 2001/0000885 | A1 | 5/2001 | Beuershausen et al. | |
| 2001/0030066 | A1 | 10/2001 | Clydesdale et al. | |
| 2002/0092684 | A1 | 7/2002 | Singh et al. | |
| 2002/0100618 | A1 | 8/2002 | Watson et al. | |
| 2002/0108785 | A1 | 8/2002 | Slaughter, Jr. et al. | |
| 2004/0031625 | A1 | 2/2004 | Lin et al. | |
| 2004/0099448 | A1 | 5/2004 | Fielder et al. | |
| 2004/0238224 | A1 | 12/2004 | Runia | |
| 2005/0087370 | A1 | 4/2005 | Ledgerwood, III et al. | |
| 2005/0103533 | A1 | 5/2005 | Sherwood, Jr. et al. | |
| 2005/0167161 | A1 | 8/2005 | Aaron et al. | |
| 2005/0178587 | A1 | 8/2005 | Witman et al. | |
| 2005/0183892 | A1 | 8/2005 | Oldham et al. | |
| 2005/0252691 | A1 | 11/2005 | Bramlett et al. | |
| 2005/0263328 | A1 | 12/2005 | Middlemiss | |
| 2005/0273301 | A1 | 12/2005 | Huang | |
| 2006/0027401 | A1 | 2/2006 | Nguyen | |
| 2006/0032674 | A1 | 2/2006 | Chen et al. | |
| 2006/0032677 | A1 | 2/2006 | Aza et al. | |
| 2006/0162969 | A1 | 7/2006 | Belnap et al. | |
| 2006/0196699 | A1 | 9/2006 | Estes et al. | |
| 2006/0254830 | A1 | 11/2006 | Radtke | |
| 2006/0266558 | A1 | 11/2006 | Middlemiss et al. | |
| 2006/0266559 | A1 | 11/2006 | Keshavan et al. | |
| 2006/0278442 | A1 | 12/2006 | Kristensen | |
| 2006/0283640 | A1 | 12/2006 | Estes et al. | |
| 2007/0029114 | A1 | 2/2007 | Middlemiss | |
| 2007/0034414 | A1 | 2/2007 | Singh et al. | |
| 2007/0046119 | A1 | 3/2007 | Cooley | |
| 2007/0062736 | A1 | 3/2007 | Cariveau et al. | |
| 2007/0079994 | A1 | 4/2007 | Middlemiss | |
| 2007/0084640 | A1 | 4/2007 | Singh | |
| 2007/0131457 | A1 | 6/2007 | McDonough et al. | |
| 2007/0187155 | A1 | 8/2007 | Middlemiss | |
| 2007/0221417 | A1 | 9/2007 | Hall et al. | |
| 2007/0227781 | A1 | 10/2007 | Cepeda et al. | |
| 2007/0272445 | A1 | 11/2007 | Cariveau et al. | |
| 2008/0028891 | A1 | 2/2008 | Calnan et al. | |
| 2008/0029308 | A1 | 2/2008 | Chen | |
| 2008/0066970 | A1 | 3/2008 | Zahradnik et al. | |
| 2008/0087471 | A1 | 4/2008 | Chen et al. | |
| 2008/0093128 | A1 | 4/2008 | Zahradnik et al. | |
| 2008/0156543 | A1 | 7/2008 | McDonough et al. | |
| 2008/0164069 | A1 | 7/2008 | McDonough et al. | |
| 2008/0264695 | A1 | 10/2008 | Zahradnik et al. | |
| 2008/0296068 | A1 | 12/2008 | Zahradnik et al. | |
| 2008/0308320 | A1 | 12/2008 | Kolachalam | |
| 2009/0044984 | A1 | 2/2009 | Massey et al. | |
| 2009/0114454 | A1 | 5/2009 | Belnap et al. | |
| 2009/0120693 | A1 | 5/2009 | McClain et al. | |
| 2009/0126998 | A1 | 5/2009 | Zahradnik et al. | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0178856 | A1 | 7/2009 | Singh et al. | |
| 2009/0183925 | A1 | 7/2009 | Zhang et al. | |
| 2009/0236147 | A1 | 9/2009 | Koltermann et al. | |
| 2009/0272582 | A1 | 11/2009 | McCormick et al. | |
| 2009/0283332 | A1 | 11/2009 | Dick et al. | |
| 2010/0012392 | A1 | 1/2010 | Zahradnik et al. | |
| 2010/0018777 | A1 | 1/2010 | Pessier et al. | |
| 2010/0043412 | A1 | 2/2010 | Dickinson et al. | |
| 2010/0155146 | A1 | 6/2010 | Nguyen et al. | |
| 2010/0224417 | A1 | 9/2010 | Zahradnik et al. | |
| 2010/0252326 | A1 | 10/2010 | Bhome et al. | |
| 2010/0276205 | A1 | 11/2010 | Oxford et al. | |
| 2010/0288561 | A1 | 11/2010 | Zahradnik et al. | |
| 2010/0319993 | A1 | 12/2010 | Bhome et al. | |
| 2010/0320001 | A1 | 12/2010 | Kulkarni | |
| 2011/0024197 | A1 | 2/2011 | Centala et al. | |
| 2011/0079440 | A1 | 4/2011 | Buske et al. | |
| 2011/0079441 | A1 | 4/2011 | Buske et al. | |
| 2011/0079442 | A1 | 4/2011 | Buske et al. | |
| 2011/0079443 | A1 | 4/2011 | Buske et al. | |
| 2011/0085877 | A1 | 4/2011 | Osborne, Jr. | |
| 2011/0162893 | A1 | 7/2011 | Zhang | |
| 2011/0283628 | A1 | 11/2011 | Saridikmen et al. | |
| 2012/0111638 | A1 | 5/2012 | Nguyen et al. | |
| 2012/0205160 | A1 | 8/2012 | Ricks et al. | |
| 2013/0313021 | A1 | 11/2013 | Zahradnik et al. | |
| 2015/0152687 | A1 | 6/2015 | Nguyen et al. | |
| 2015/0197992 | A1 | 7/2015 | Ricks et al. | |
| 2015/0211303 | A1 | 7/2015 | Buske et al. | |

FOREIGN PATENT DOCUMENTS

| | | | |
|---|---|---|---|
| EP | 0238758 | A2 | 9/1987 |
| EP | 0157278 | | 11/1989 |
| EP | 0391683 | | 1/1996 |
| EP | 0874128 | | 10/1998 |
| EP | 874128 | A2 | 10/1998 |
| EP | 2089187 | | 8/2009 |
| GB | 2183694 | | 6/1987 |
| GB | 2194571 | | 3/1988 |
| GB | 2364340 | | 1/2002 |
| GB | 2403313 | | 12/2004 |
| JP | 2001159289 | | 6/2001 |
| SU | 1331988 | | 6/1987 |
| WO | 8502223 | | 5/1985 |
| WO | 2008124572 | | 10/2008 |
| WO | 2009135119 | | 11/2009 |
| WO | 2010127382 | | 11/2010 |
| WO | 2010135605 | | 11/2010 |
| WO | 2015102891 | | 7/2015 |

OTHER PUBLICATIONS

Ersoy, et al., "Wear characteristics of PDC pin and hybrid core bits in rock drilling", Wear 188, Elsevier Science, S. A., pp. 150-165, Mar. 1995.

George, et al., "Significant Cost Savings Achieved Through the Use of PDC Bits in Compressed Air/Foam Applications", Society of Petroleum Engineers—SPE 116118, 2008 SPE Annual Technical Conference and Exhibition, Denver, Colorado, Sep. 21-24, 2008.

International Preliminary Report on Patentability for the International Patent Application No. PCT/US2010/039100, The International Bureau of WIPO, Switzerland, dated Jan. 5, 2012.

International Preliminary Report on Patentability for International Patent Application No. PCT/ US2009/042514, The International Bureau of WIPO, dated Nov. 2, 2010.

International Preliminary Report of Patentability for International Patent Application No. PCT/ US2009/050672, The International Bureau of WIPO, dated Jan. 25, 2011.

International Search Report for International Patent Application No. PCT/US2015/014011, USPTO, dated Apr. 24, 2015.

International Search Report for International Patent Application No. PCT/ US2012/024134, European Patent Office, dated Mar. 7, 2013.

International Search Report for International Patent Application No. PCT/US2015/032230, European Patent Office, dated Nov. 16, 2015.

(56) References Cited

OTHER PUBLICATIONS

International Search Report for International Patent Application No. PCT/US2010/032511, Korean Intellectual Property Office, dated Jan. 17, 2011.
International Search Report for International Patent Application No. PCT/US2010/033513, Korean Intellectual Property Office, dated Jan. 10, 2011.
International Search Report for International Patent Application No. PCT/US2010/039100, Korean Intellectual Property Office, dated Jan. 25, 2011.
International Search Report for International Patent Application No. PCT/US2011/042437, European Patent Office, dated Nov. 9, 2011.
International Search Report for International Patent Application No. PCT/US2009/042514, Korean Intellectual Property Office, dated Nov. 27, 2009.
International Search Report for International Patent Application No. PCT/US2010/049159, European Patent Office, dated Apr. 21, 2011.
International Search Report for International Patent Application No. PCT/US2010/050631, European Patent Office, dated Jun. 10, 2011.
International Search Report for International Patent Application No. PCT/US2009/050672, Korean Intellectual Property Office, dated Mar. 3, 2010.
International Search Report for International Patent Application No. PCT/US2010/051014, European Patent Office, dated Jun. 9, 2011.
International Search Report for International Patent Application No. PCT/US2010/051017, European Patent Office, dated Jun. 8, 2011.
International Search Report for International Patent Application No. PCT/US2010/051019, European Patent Office, dated Jun. 6, 2011.
International Search Report for International Patent Application No. PCT/US2010/051020, European Patent Office, dated Jun. 1, 2011.
International Search Report for International Patent Application No. PCT/US2009/067969, Korean Intellectual Property Office, dated May 25, 2010.
International Search Report for International Patent Application No. PCT/US2008/083532, European Patent Office, dated Feb. 25, 2009.
Written Opinion for International Patent Application No. PCT/US2015/014011, USPTO, dated Apr. 24, 2015.
Written Opinion for International Patent Application No. PCT/US2012/024134, European Patent Office, dated Mar. 7, 2013.
Written Opinion for International Patent Application No. PCT/US2015/032230, European Patent Office, dated Nov. 16, 2015.
Written Opinion for International Patent Application No. PCT/US2010/032511, Korean Intellectual Property Office, dated Jan. 17, 2011.
Written Opinion for International Patent Application No. PCT/US2010/033513, Korean Intellectual Property Office, dated Jan. 10, 2011.
Written Opinion for International Patent Application No. PCT/US2010/039100, Korean Intellectual Property Office, dated Jan. 25, 2011.
Written Opinion for International Patent Application No. PCT/US2011/042437, European Patent Office, dated Nov. 9, 2011.
Written Opinion for International Patent Application No. PCT/US2009/042514, Korean Intellectual Property Office, dated Nov. 27, 2009.
Written Opinion for International Patent Application No. PCT/US2010/049159, European Patent Office, dated Apr. 21, 2011.
Written Opinion for International Patent Application No. PCT/US2010/050631, European Patent Office, dated Jun. 10, 2011.
Written Opinion for International Patent Application No. PCT/US2009/050672, Korean Intellectual Property Office, dated Mar. 3, 2010.
Written Opinion for International Patent Application No. PCT/US2010/051014, European Patent Office, dated Jun. 9, 2011.
Written Opinion for International Patent Application No. PCT/US2010/051017, European Patent Office, dated Jun. 8, 2011.
Written Opinion for International Patent Application No. PCT/US2010/051019, European Patent Office, dated Jun. 6, 2011.
Written Opinion for International Patent Application No. PCT/US2010/051020, European Patent Office, dated Jun. 1, 2011.
Written Opinion for International Patent Application No. PCT/US2009/067969, Korean Intellectual Property Office, dated May 25, 2010.
Written Opinion for International Patent Application No. PCT/US2008/083532, European Patent Office, dated Feb. 25, 2009.
Mills Machine Company, "Rotary Hole Openers—Section 8", retrieved from the internet on May 7, 2009 using <URL: http:1fwww.millsmachine.com/pages/home_page/mills_catalog/cat_holeopen/cat_holeopen _pdf>.
Pessier, et al., "Hybrid Bits Offer Distinct Advantages in Selected Roller Cone and PDC Bit Applications", IADC/SPE Paper No. 128741, Feb. 2010, pp. 1-9.
Sheppard, et al., "Rock Drilling—Hybrid Bit Success for Syndax3 Pins", Industrial Diamond Review, pp. 309-311, Jun. 1993.
Smith Services, "Hole Opener—Model 6980 Hole Opener", retrieved from the internet on May 7, 2008 using <URL: http://www.siismithservices.com/b_products/product_page.asp?ID=589>.
Tomlinson, et al., "Rock Drilling—Syndax3 Pins—New Concepts in PCD Drilling", Industrial Diamond Review, pp. 109-114, Mar. 1992.
Warren, et al., "PDC Bits: What's Needed to Meet Tomorrow's Challenge", SPE 27978, University of Tulsa Centennial Petroleum Engineering Symposium, pp. 207-214, Aug. 1994.
Wells, et al., "Bit Balling Mitigation in PDC Bit Design", International Association of Drilling Contractors/ Society of Petroleum Engineers—IADC/SPE 114673, IADC/SPE Asia Pacific Drilling Technology Conference and Exhibition, Indonesia, Aug. 25-27, 2008.
Williams, et al., "An Analysis of the Performance of PDC Hybrid Drill Bits", SPEIIADC 16117, SPE/IADC Drilling Conference, pp. 585-594, Mar. 1987.
European Search Report for European Application No. 15743583 dated Sep. 20, 2017, 7 pages.
First Office Action for Chinese Patent Application No. 201280013361.9 dated Nov. 2, 2014 (12 pages) Translation only.

* cited by examiner

EARTH-BORING ROTARY TOOLS HAVING FIXED BLADES AND ROLLING CUTTER LEGS, AND METHODS OF FORMING SAME

CROSS-REFERENCE TO RELATED APPLICATIONS

This application is a continuation of U.S. patent application Ser. No. 14/665,403, filed Mar. 23, 2015, now U.S. Pat. No. 9,476,259, issued Oct. 25, 2016, which is a continuation of U.S. Patent application Ser. No. 13/367,526, filed Feb. 7, 2012, now abandoned, which claims priority to U.S. Provisional Patent Application Ser. No. 61/441,907, filed Feb. 11, 2011, and entitled "System and Method for Leg Retention on Hybrid Bits," the disclosure of each of which is hereby incorporated herein in its entirety by this reference.

TECHNICAL FIELD

The present invention relates in general to earth-boring drill bits and, in particular, to a bit having a combination of rolling and fixed cutters and cutting elements and a method of drilling with same.

BACKGROUND

U.S. Pat. No. 3,294,186 discloses the use of nickel shims for brazing of rock bit components.

U.S. Pat. No. 3,907,191 discloses a "rotary rock bit is constructed from a multiplicity of individual segments. Each individual segment includes two parting faces and a gage cutting surface. The individual segments are positioned adjacent each other with the parting faces of the adjacent segments in abutting relationship to one another. A ring gage is positioned around the segments and the individual segments are moved relative to one another causing the parting faces of an individual segment to slide against the parting faces of the adjacent segments. The segments are moved until the gage cutting surfaces of the segments contact the ring gage thereby insuring that the finished bit will have the desired gage size. The segments are welded together over a substantial portion of the parting faces."

U.S. Pat. No. 5,439,067 discloses a "rotary cone drill bit for forming a borehole having a one-piece bit body with a lower portion having a convex exterior surface and an upper portion adapted for connection to a drill string. A number of support arms are preferably attached to the bit body and depend therefrom. Each support arm has an inside surface with a spindle connected thereto and an outer surface. Each spindle projects generally downwardly and inwardly with respect to the associated support arm. A number of cone cutter assemblies equal to the number of support arms are mounted on each of the spindles. The support arms are spaced on the exterior of the bit body to provide enhanced fluid flow between the lower portion of the bit body and the support arms. Also, the length of the support arms is selected to provide enhanced fluid flow between the associated cutter cone assembly and the lower portion of the bit body. The same bit body may be used with various rotary cone drill bits having different gauge diameters."

U.S. Pat. No. 5,439,068 discloses a "rotary cone drill bit for forming a borehole having a one-piece bit body with a lower portion having a convex exterior surface and an upper portion adapted for connection to a drill string. The drill bit will generally rotate around a central axis of the bit body. A number of support arms are preferably attached to pockets formed in the bit body and depend therefrom. Each support arm has an inside surface with a spindle connected thereto and an outer surface. Each spindle projects generally downwardly and inwardly with respect to the longitudinal axis of the associated support arm and the central axis of the bit body. A number of cone cutter assemblies equal to the number of support arms are mounted respectively on each of the spindles. The spacing between each of the support arms along with their respective length and width dimensions are selected to enhance fluid flow between the cutter cone assemblies mounted on the respective support arms and the lower portion of the bit body. A lubricant reservoir is preferably provided in each support arm to supply lubricant to one or more bearing assemblies disposed between each cutter cone assembly and its associated spindle. Either matching openings and posts or matching keyways and keys may be used to position and align a portion of each support arm within its associated pocket during fabrication of the resulting drill bit."

U.S. Pat. No. 5,595,255 discloses a "rotary cone drill bit for forming a borehole having a bit body with an upper end portion adapted for connection to a drill string. The drill bit rotates around a central axis of the body. A number of support arms preferably extend from the bit body. The support arms may either be formed as an integral part of the bit body or attached to the exterior of the bit body in pockets sized to receive the associated support arm. Each support arm has a lower portion with an inside surface and a spindle connected thereto and an outer shirttail surface. Each spindle projects generally downwardly and inwardly with respect to its associated support arm. A number of cutter cone assemblies equal to the number of support arms are mounted respectively on the spindles. A throat relief area is provided on the lower portion of each support arm adjacent to the associated spindle to increase fluid flow between the support arm and the respective cutter cone assembly."

U.S. Pat. No. 5,606,895 discloses a "rotary cone drill bit having a one-piece bit body with a lower portion having a convex exterior surface and an upper portion adapted for connection to a drill string. The drill bit will generally rotate around a central axis of the bit body to form a borehole. A number of support arms are preferably attached to pockets formed in the bit body and depend therefrom. The bit body and support arms cooperate with each other to reduce initial manufacturing costs and to allow rebuilding of a worn drill bit. Each support arm has an inside surface with a spindle connected thereto and an outer shirttail surface. Each spindle projects generally downwardly and inwardly with respect to the longitudinal axis of the associated support arm and the central axis of the bit body. A number of cone cutter assemblies equal to the number of support arms are mounted respectively on each of the spindles. The radial spacing of the support arms on the perimeter of the associated bit body along with their respective length and width dimensions are selected to enhance fluid flow between the cutter cone assemblies mounted on the respective support arms and the lower portion of the bit body. The resulting drill bit provides enhanced fluid flow, increased seal and bearing life, improved downhole performance and standardization of manufacturing and design procedures."

U.S. Pat. No. 5,624,002 discloses a "rotary cone drill bit having a one-piece bit body with a lower portion having a convex exterior surface and an upper portion adapted for connection to a drill string. The drill bit will generally rotate around a central axis of the bit body to form a borehole. A number of support arms are preferably attached to pockets formed in the bit body and depend therefrom. The bit body and support arms cooperate with each other to reduce initial manufacturing costs and to allow rebuilding of a worn drill bit. Each support arm has an inside surface with a spindle connected thereto and an outer shirttail surface. Each spindle projects generally downwardly and inwardly with respect to the longitudinal axis of the associated support arm and the central axis of the bit body. A number of cone cutter assemblies equal to the number of support arms are mounted respectively on each of the spindles. The radial spacing of the support arms on the perimeter of the associated bit body along with their respective length and width dimensions are selected to enhance fluid flow between the cutter cone assemblies mounted on the respective support arms and the lower portion of the bit body. The resulting drill bit provides enhanced fluid flow, increased seal and bearing life, improved downhole performance and standardization of manufacturing and design procedures."

U.S. Design Pat. No. D372,253 shows a support arm and rotary cone for a modular drill bit.

The invention disclosed and taught herein is directed to an improved hybrid bit having a combination of rolling and fixed cutters and cutting elements.

BRIEF SUMMARY

The invention disclosed and taught herein is directed to an earth-boring drill bit comprising: one or more legs; a bit body having a blade and a slot for receiving the leg; and one or more wedges between the leg and the slot fixing the leg within the slot. The slot may have two parallel sidewalls with one of the sidewalls forming an acute angle and the other forming an obtuse angle. The wedge may be secured immediately next to the obtusely angled sidewall. The wedge may have two obtusely angled sides. The bit may include one or more bolts through each wedge to secure both the wedge and the leg to the bit body. In alternative embodiments, the slot may have two sidewalls that are not parallel to each other, such as with a first one of the sidewalls extending about straight outwardly from an axial center of the bit body. In this case, the wedge is preferably secured immediately next to this first sidewall. In most cases, however, an obtusely angled sidewall of the wedge is preferably secured immediately next to an acutely angled side of the leg.

DETAILED DESCRIPTION

The figures described above and the written description of specific structures and functions below are not presented to limit the scope of what Applicants have invented or the scope of the appended claims. Rather, the figures and written description are provided to teach any person skilled in the art to make and use the inventions for which patent protection is sought. Those skilled in the art will appreciate that not all features of a commercial embodiment of the invention are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the invention disclosed and taught herein is susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like, are used in the written description for clarity in specific reference to the figures and are not intended to limit the scope of the invention or the appended claims.

Applicants have created an earth-boring drill bit comprising: one or more legs; a bit body having a blade and a slot for receiving the leg; and one or more wedges between the leg and the slot fixing the leg within the slot. The slot may have two parallel sidewalls with one of the sidewalls forming an acute angle and the other forming an obtuse angle. The wedge may be secured immediately next to the obtusely angled sidewall. The wedge may have two obtusely angled sides. The bit may include one or more bolts through each wedge to secure both the wedge and the leg to the bit body. In alternative embodiments, the slot may have two sidewalls that are not parallel to each other, such as with a first one of the sidewalls extending about straight outwardly from an axial center of the bit body. In this case, the wedge is preferably secured immediately next to this first sidewall. In most cases, however, an obtusely angled sidewall of the wedge is preferably secured immediately next to an acutely angled side of the leg.

Figure 1:
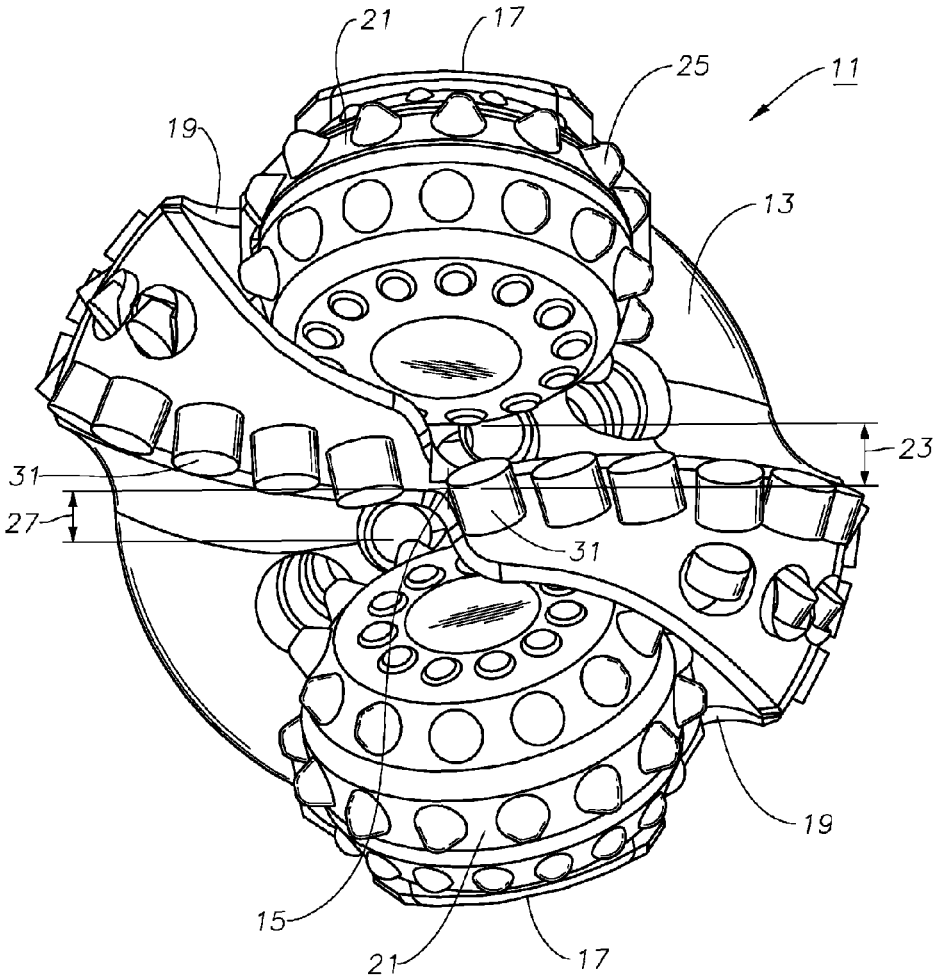
FIG. 1 is a bottom plan view of an embodiment of a hybrid earth-boring bit.
Figure 2:
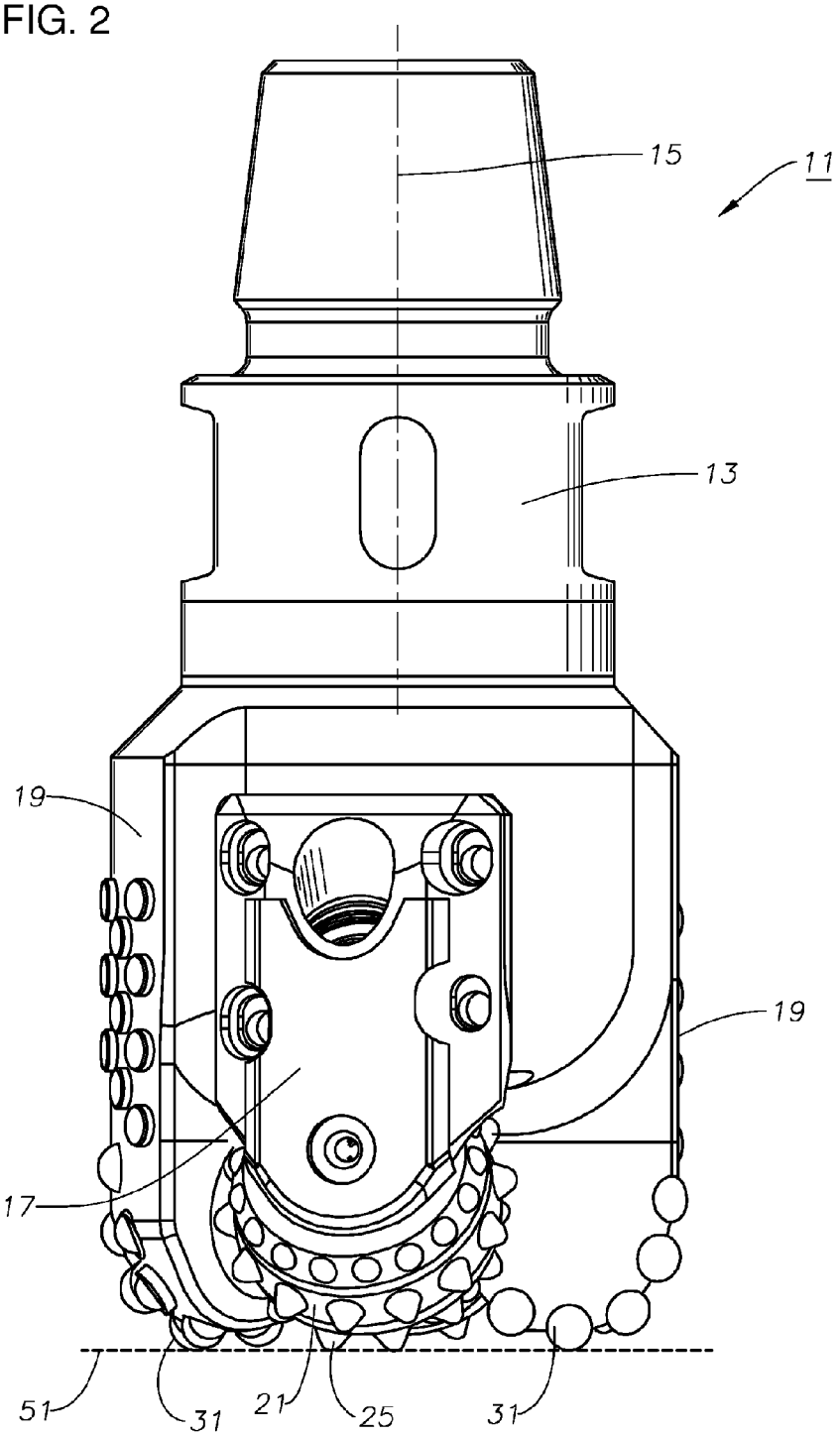
FIG. 2 is a side elevation view of an embodiment of the hybrid earth-boring bit of FIG. 1.

Referring to FIGS. 1 and 2, an illustrative embodiment of a modular hybrid earth-boring drill bit is disclosed. The bit 11 may be similar to that shown in U.S. Patent Application Publication No. 2009/0272582 and/or 2008/0296068, both of which are incorporated herein by specific reference. The bit 11 comprises a bit body 13 having a longitudinal axis 15 that defines an axial center of the bit body 13. A plurality (e.g., two shown) of bit legs or heads 17 extend from the bit body 13 in the axial direction, parallel to the longitudinal axis 15. Because the legs 17 are secured about the bit body 13, the legs may also protrude radially from the bit body 13. The bit body 13 also has a plurality of fixed blades 19 that extend in the axial direction.

Rolling cutters 21 are mounted to respective ones of the bit legs 17. Each of the rolling cutters 21 is shaped and located such that every surface of the rolling cutters 21 is radially spaced apart from the axial center 15 by a minimal radial distance 23. A plurality of roller cone cutting inserts or elements 25 are mounted to the rolling cutters 21 and radially spaced apart from the axial center 15 by a minimal radial distance 27. The minimal radial distances 23, 27 may vary according to the application, and may vary from cutter to cutter, and/or cutting element to cutting element.

In addition, a plurality of fixed cutting elements 31 are mounted to the fixed blades 19. At least one of the fixed cutting elements 31 may be located at the axial center 15 of the bit body 13 and adapted to cut a formation at the axial center. In one embodiment, the at least one of the fixed cutting elements 31 is within approximately 0.040 inch of the axial center. Examples of roller cone cutting elements 25 and fixed cutting elements 31 include tungsten carbide inserts, cutters made of super-hard material such as polycrystalline diamond, and others known to those skilled in the art.

Figure 3:
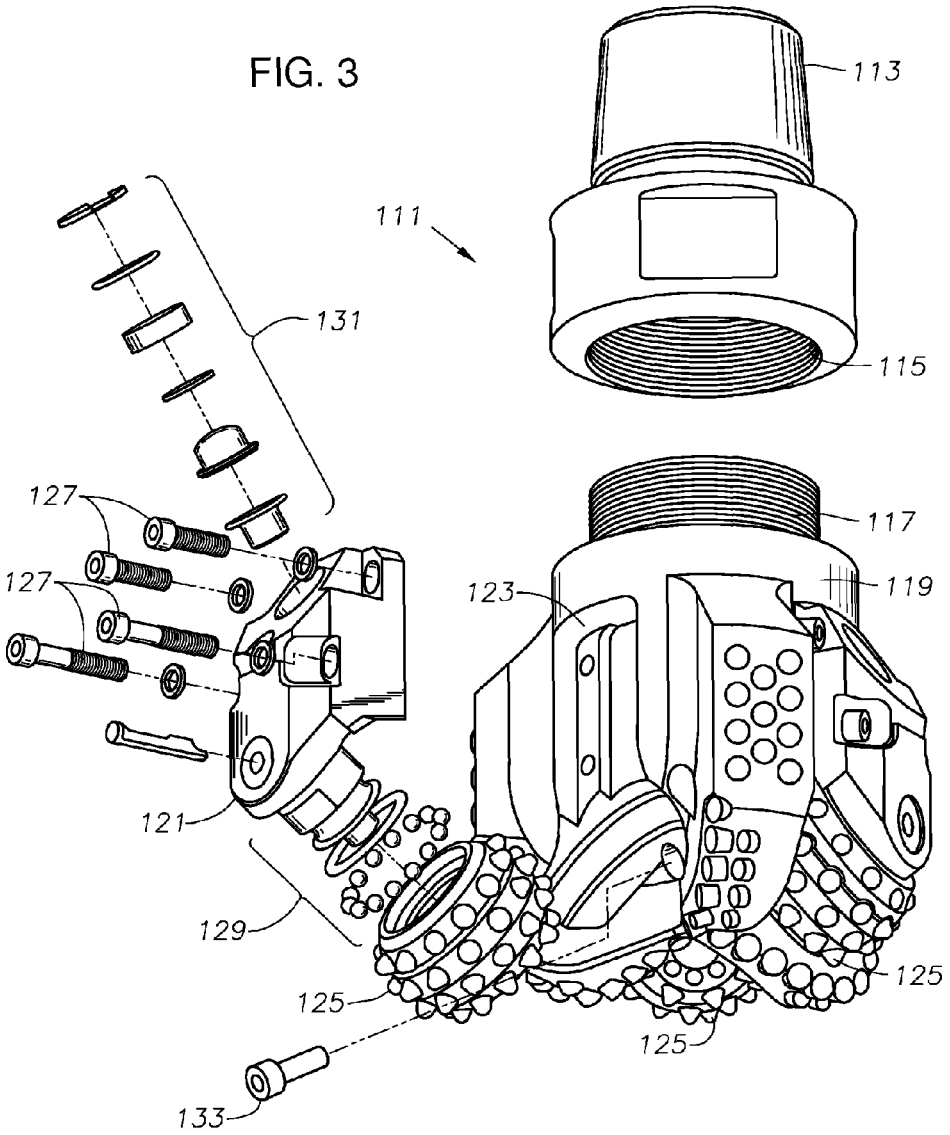
FIG. 3 is an exploded view of another embodiment of the hybrid earth-boring bit of FIG. 1 constructed in accordance with the present invention.

FIG. 3 illustrates the modular aspect of the bit 11. FIG. 3 is an exploded view of the various parts of the bit 111 disassembled. The illustrative embodiment of FIG. 3 is a three-cutter, three-blade bit. The modular construction principles of the present invention are equally applicable to the two-cutter, two-blade bit 11 of FIGS. 1 and 2, and hybrid bits with any combination of fixed blades and rolling cutters.

As illustrated, bit 111 comprises a shank portion or section 113, which is threaded or otherwise configured at its upper extent for connection into a drillstring. At the lower extent of shank portion 113, a generally cylindrical receptacle 115 is formed. Receptacle 115 receives a correspondingly shaped and dimensioned cylindrical portion 117 at the upper extent of a bit body portion 119. Shank 113 and body portions 119 are joined together by inserting the cylindrical portion 117 at the upper extent of body portion 119 into the cylindrical receptacle 115 in the lower extent of shank 113. For the 12.25-inch bit shown, the receptacle is a Class 2 female thread that engages with a mating male thread at the upper extent of the body. The circular seam or joint is then continuously bead welded to secure the two portions or sections together. Receptacle 115 and upper extent of portion 117 need not be cylindrical, but could be other shapes that mate together, or could be a sliding or running fit relying on the weld for strength. Alternatively, the joint could be strengthened by a close interference fit between upper extent of bit body portion 119 and receptacle 115. Tack welding around, and/or fully welding, the seam could also be used.

A bit leg or head 17, 121 (three are shown) is received in an axially extending slot 123 (again, there is a slot 123 for each leg or head 121). The slot 123 may be dovetailed (and leg 121 correspondingly shaped) so that only axial sliding of leg 121 is permitted and leg 121 resists radial removal from slot 123. A plurality (four) of bolts 127 and washers secure each leg 121 in slot 123 so that leg 121 is secured against axial motion in and removal from slot 123. A rolling cutter 125 is secured on a bearing associated with each leg 121 by a ball lock and seal assembly 129. The apertures in leg 121 through which bolts 127 extend may be oblong and/or oversized, to permit the axial and/or radial positioning of leg 121 within slot 123, which, in turn, permits selection of the relative projection of the cutting elements on each rolling cutter. A lubricant compensator assembly 131 is also carried in each leg 121 and supplies lubricant to the bearing assembly and compensates for pressure variations in the lubricant during drilling operations. At least one nozzle 133 is received and retained in the bit body portion 119 to direct a stream of drilling fluid from the interior of bit 111 to selected locations proximate the cutters and blades of the bit.

The slot 123 preferably has a pair of adjacent opposing sidewalls 135, 135*a*, 135*b* (FIG. 6) (referred to generally with the reference numeral 135). As will be discussed in further detail below, the sidewalls 135 may be inclined. A third sidewall 137 (FIG. 6), which may be curved or flat, connects the two opposing sidewalls 135. A blind threaded hole or aperture 139 (FIG. 6) is formed in bit body 13,119 to receive each of the fasteners or bolts 127.

Figure 4:
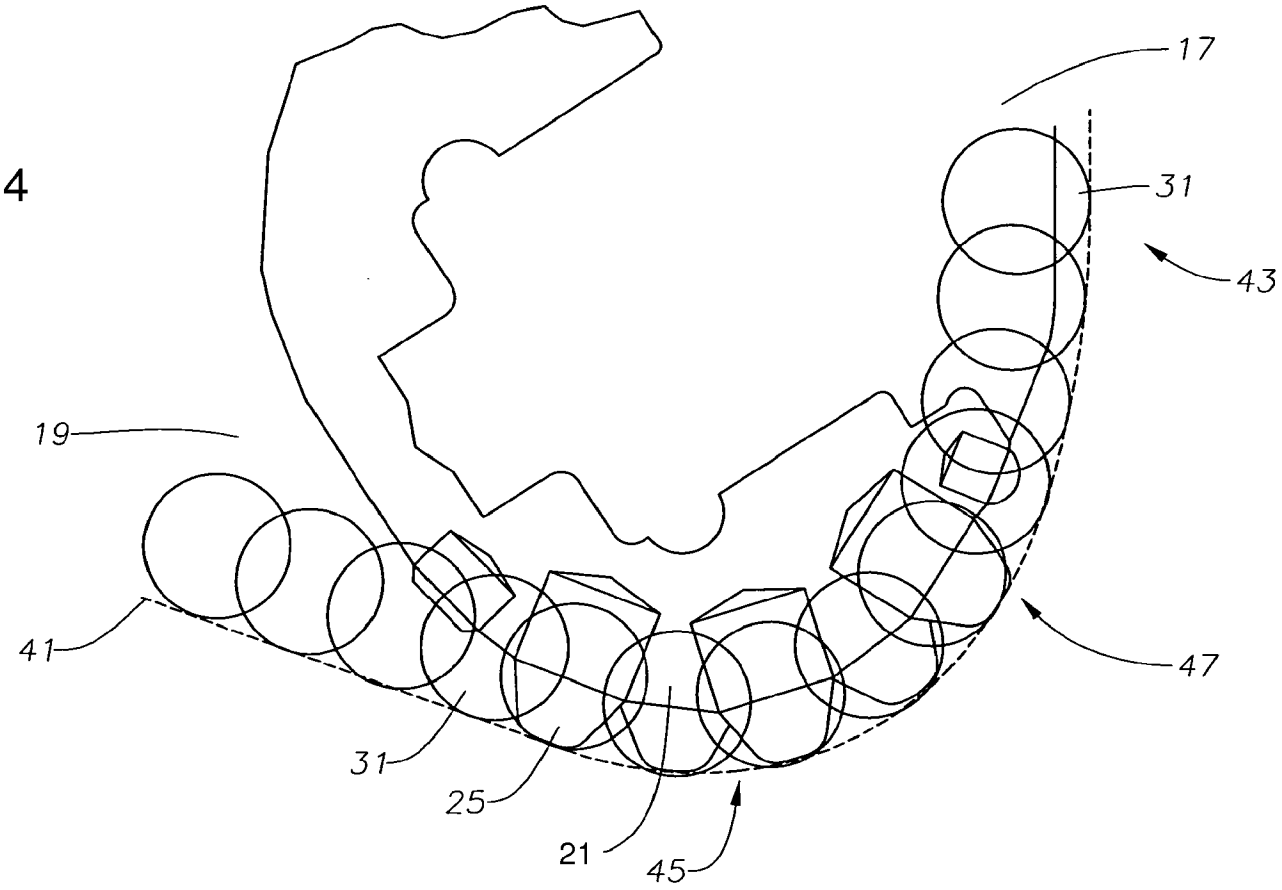
FIG. 4 is a composite rotational side view of the hybrid earth-boring drill bit of FIG. 1.

As shown in FIG. 4, the roller cone cutting elements 25 and the fixed cutting elements 31 combine to define a cutting profile 41 that extends from the axial center 15 to a radially outermost perimeter 43 with respect to the axis. In one embodiment, only the fixed cutting elements 31 form the cutting profile 41 at the axial center 15 and the radially outermost perimeter 43. However, the roller cone cutting elements 25 overlap with the fixed cutting elements 31 on the cutting profile 41 between the axial center 15 and the radially outermost perimeter 43. The roller cone cutting elements 25 are configured to cut at the nose 45 and shoulder 47 of the cutting profile 41, where the nose 45 is the leading part of the profile (i.e., located between the axial center 15 and the shoulder 47) facing the borehole wall and located adjacent the radially outermost perimeter 43.

Thus, the roller cone cutting elements 25 and the fixed cutting elements 31 combine to define a common cutting face 51 (FIG. 2) in the nose 45 and shoulder 47, which are known to be the weakest parts of a fixed cutter bit profile. Cutting face 51 is located at a distal axial end of the hybrid drill bit 11. In one embodiment, at least one of each of the roller cone cutting elements 25 and the fixed cutting elements 31 extend in the axial direction at the cutting face 51 at a substantially equal dimension. In one embodiment, the roller cone cutting elements 25 and the fixed cutting elements 31 are radially offset from each other even though they axially align. However, the axial alignment between the distal-most elements 25, 31 is not required such that elements 25, 31 may be axially spaced apart by a significant distance when in their distal-most position. For example, the roller cone cutting elements 25 or the fixed cutting elements 31 may extend beyond, or may not fully extend to, the cutting face 51. In other words, the roller cone cutting elements 25 may extend to the cutting face 51 with the fixed cutting elements 31 axially offset from the cutting face 51.

Figure 5:
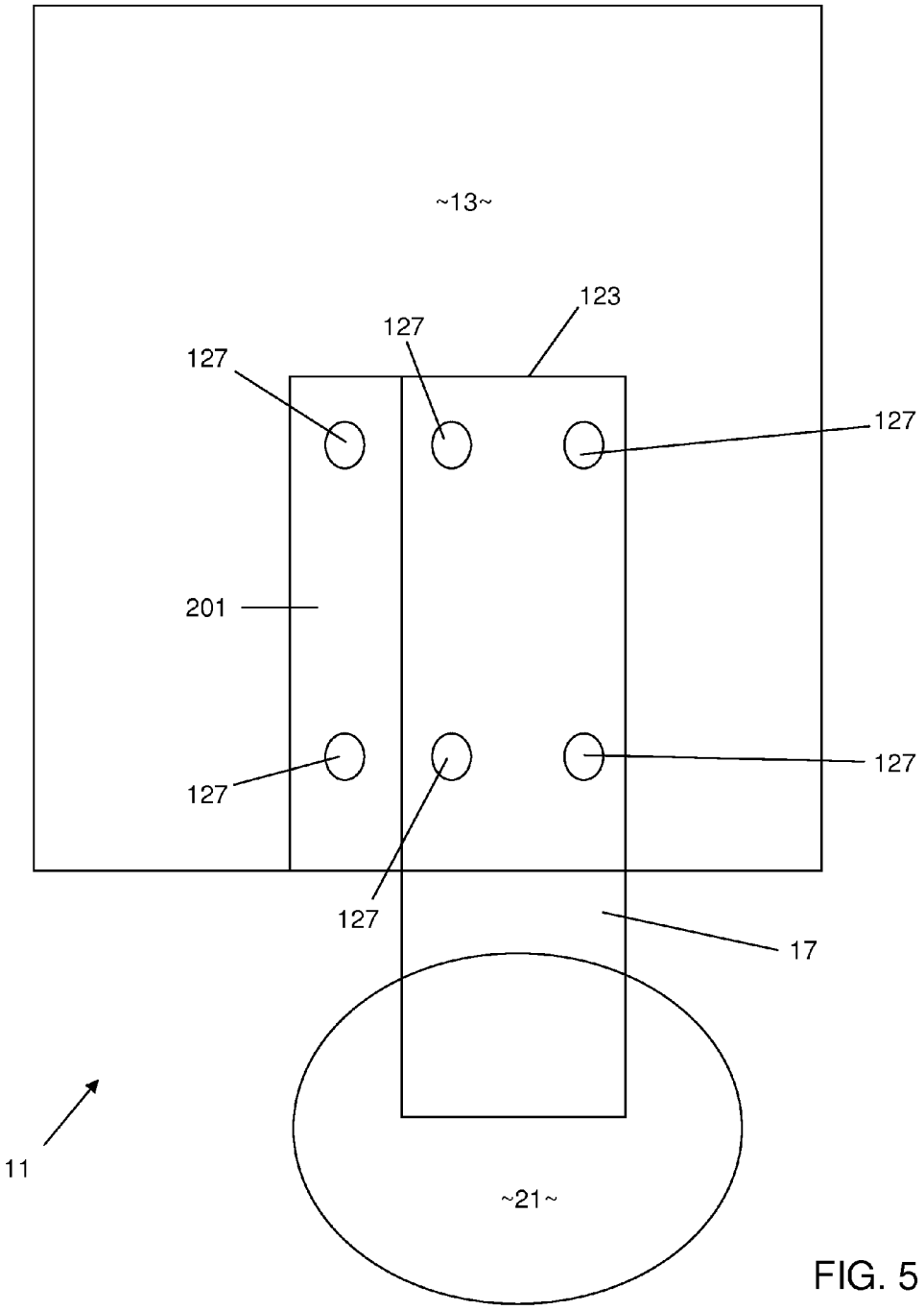
FIG. 5 is a simplified side view of the hybrid earth-boring drill bit of FIG. 1 constructed in accordance with the present invention.

Referring also to FIG. 5, while the legs 17, 121 may be welded within the slots 123 of the bit body 13, the legs may additionally, or alternatively, be secured using one or more wedges 201. The wedges 201 may also be welded and/or bolted to the bit body 13, such as by using the fasteners or bolts 127.

Figure 6:
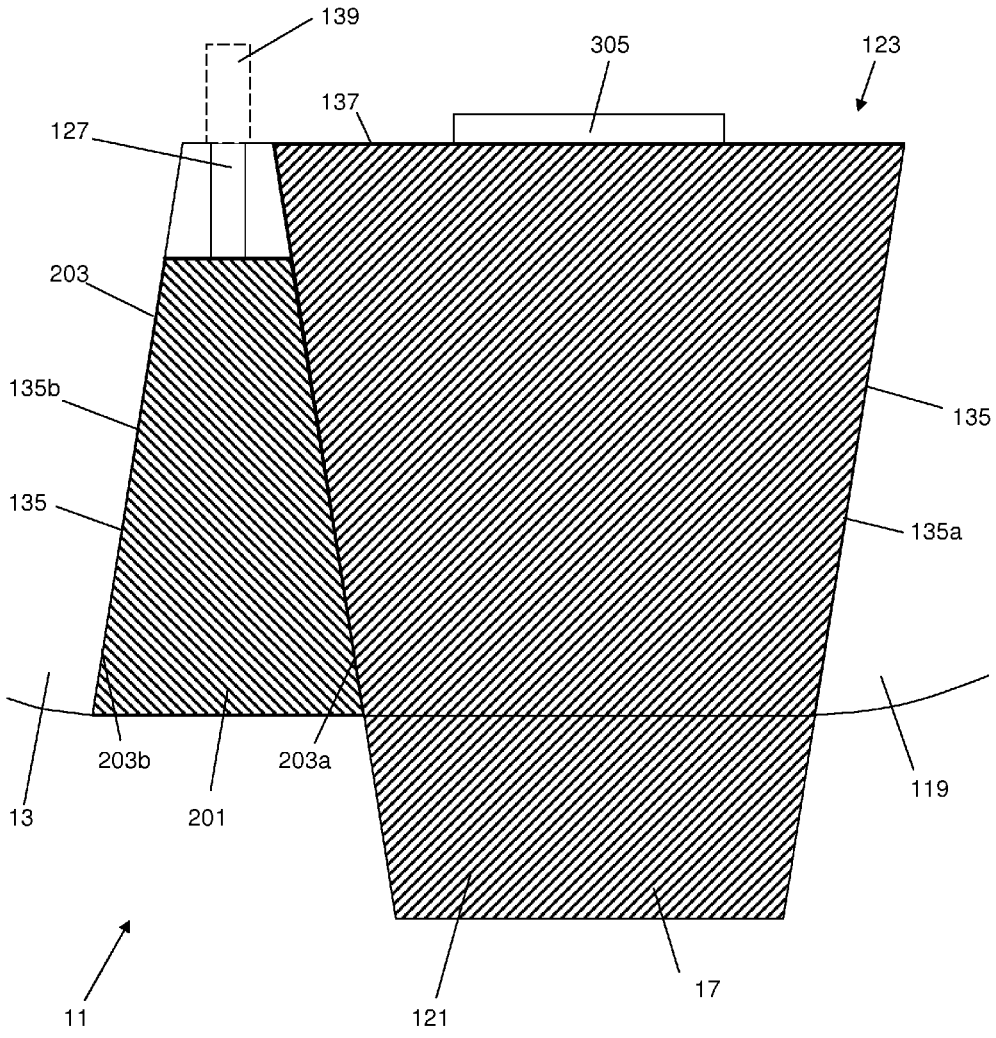
FIG. 6 is a simplified cross-sectional plan view of the hybrid earth-boring drill bit of FIG. 1 constructed in accordance with the present invention.
Figure 7:
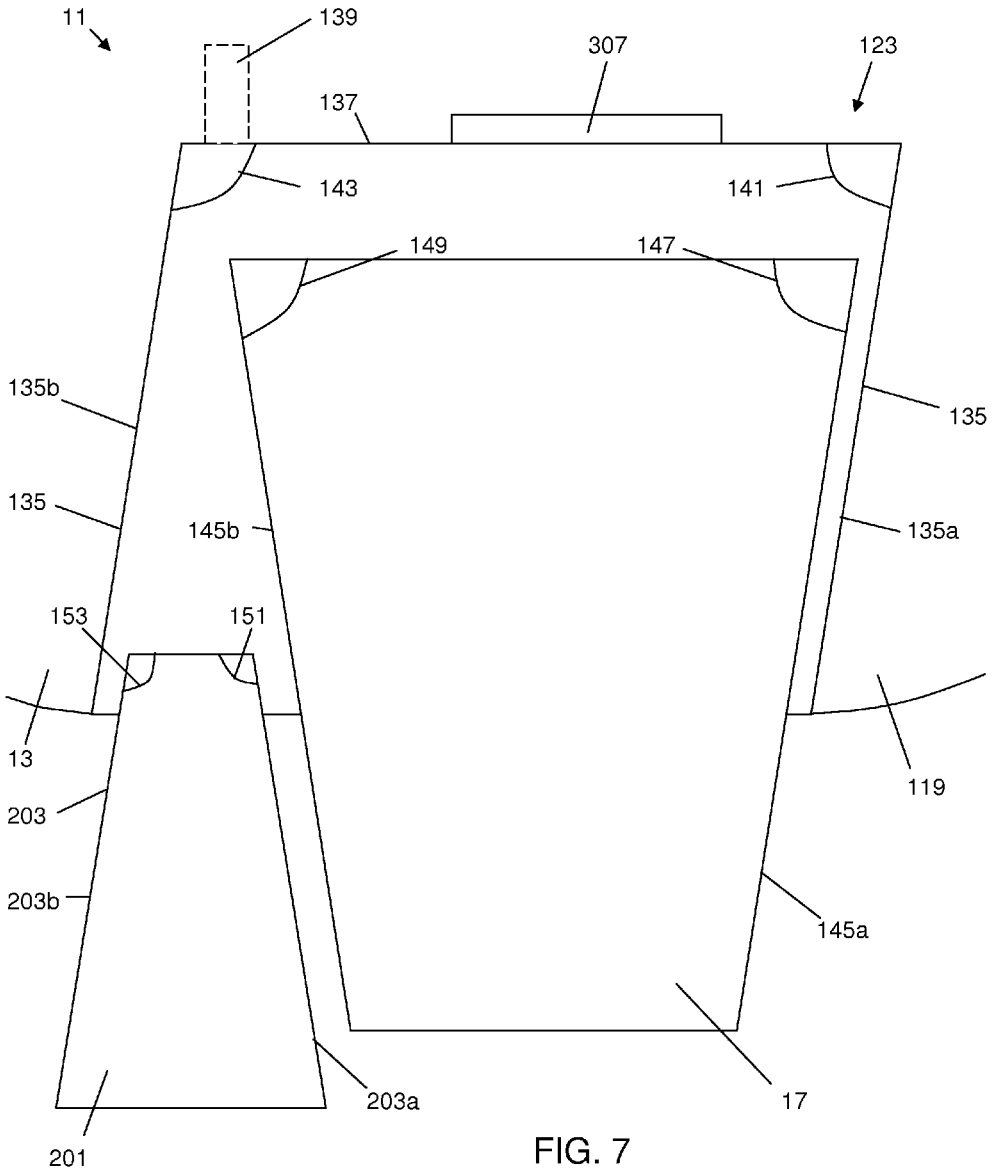
FIG. 7 is an exploded view of FIG. 6.

As shown in FIGS. 6 and 7, sidewalls 135 (e.g., sides) of the slot 123 may be inclined. More specifically, a first one of the sidewalls 135*a* may be inclined toward the other at an acute angle 141, while the other sidewall 135*b* may be inclined away from the first at an obtuse angle 143. With this construction, the leg 17 is bolted into the slot 123 with a first sidewall 145*a* resting against the acute angled sidewall 135*a* of the slot 123, thereby partially locking the leg 17 in place. An acute angle 147 of the first sidewall 145*a* of the leg 17, 121, preferably matches the acute angle 141 of the first sidewall 135*a* of the slot 123. In the preferred embodiment, a second sidewall 145*b* of the leg 17 is also aligned at an acute angle 149, which may be similar to or exactly the same as the acute angle 147 of the first sidewall 145*a* of the leg 17. The wedge 201 is then bolted into the slot 123, between the second acutely angled sidewall 145*b* of the leg 17 and the obtusely angled sidewall 135*b* of the slot 123. Because the wedge 201 preferably has two obtusely angled sides 203, 230*a*, 230*b*, which form the shown obtuse angles 151, 153, the wedge 201 firmly secures the leg 17 within the slot 123 and the bolts 127 securing the wedge 201 are tightened.

Plugs may then be welded over the bolts 127 to prevent rotation of the bolts 127 during operation, thereby further securing the wedge 201 and leg 17 within the slot 123.

The sidewalls 135 may be parallel, as shown. In this case, with the sidewalls 135 parallel as shown, the bolts 127 holding the leg 17 in place are expected to experience less tension than the bolts 127 holding the wedge 201 in place.

Alternatively, the sidewalls 135*a*, 135*b* may be angled differently, with respect to an offset from ninety degrees. For example, the first sidewall 135*a* and/or the second sidewall 135*b* may be aligned about straight outward from the axial center of the bit body 13, with the angles 141, being essentially tangentially right angles rather than the shown acute and obtuse angles. In this manner, the sidewalls 135 of the slot 123 may be closer near the axial center of the bit body 13 and angled outwardly and away from each other as they extend outwardly. This configuration would induce considerable tension loads on the bolts 127 holding both the leg 17 and the wedge 201 in place.

In still another embodiment, the first sidewall 135*a* may be angled as shown with the second sidewall 135*b* being aligned about straight outward from the axial center of the bit body 13. The angled sides 203 of the wedge 201 would still press the leg 17 against the first sidewall 135*a*, thereby pinning the leg 17 in place. Alternatively, a first side 203*a* of the wedge 201 may be angled as shown, with a second side 203*b* of the wedge 201 being aligned about straight outward from the axial center of the bit body 13, along with the second sidewall 135*b*. In this case, the angled side 203*a* of the wedge 201 would still press the leg 17 against the first sidewall 135*a*, thereby pinning the leg 17 in place. In any case, however, the sides 203, 203*a*, 203*b* of the wedge 201 are not expected to be parallel, but need not have similar angles, with respect to straight outward from the axial center of the bit body 13.

Figure 8:
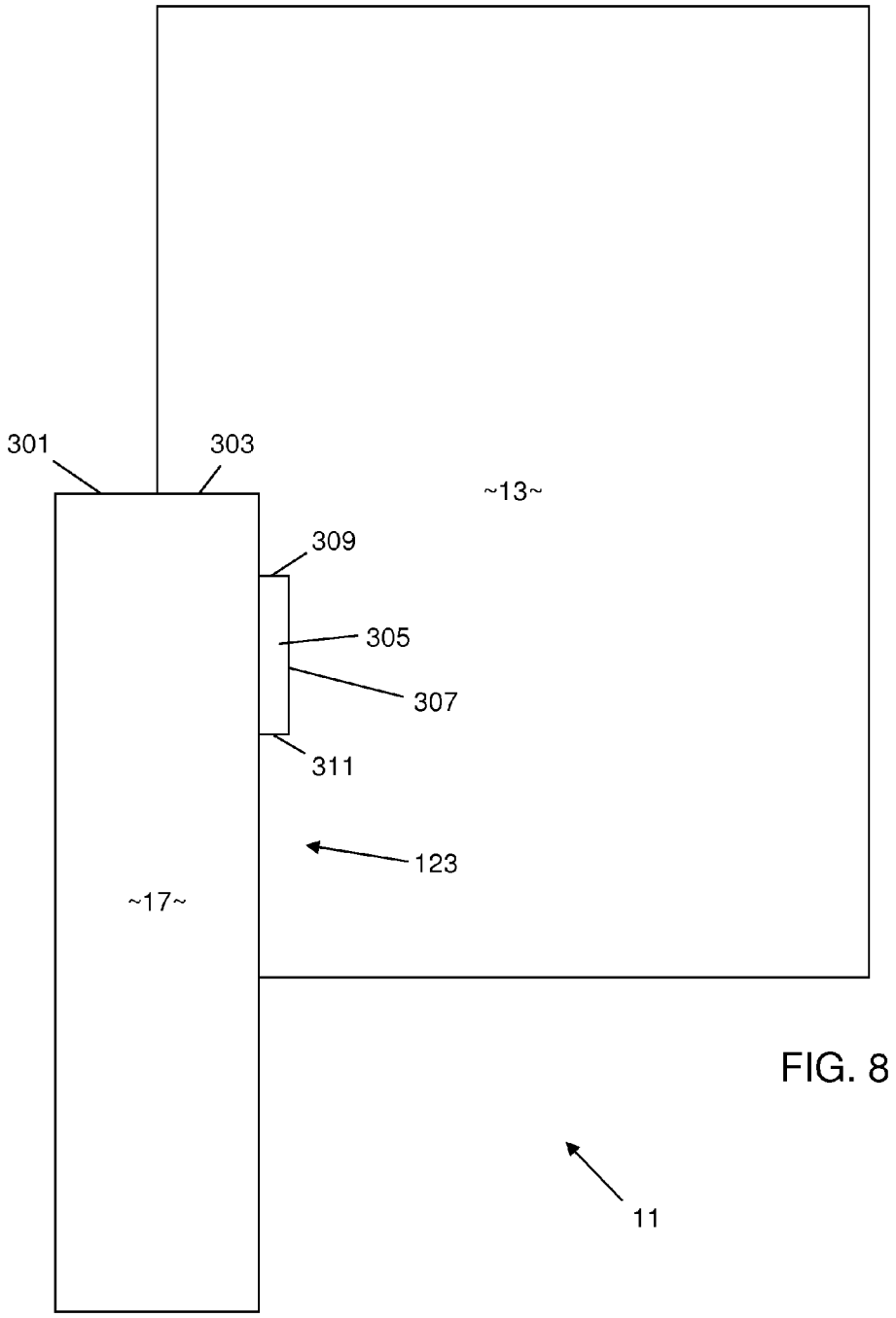
FIG. 8 is a simplified cross-sectional elevation view of the hybrid earth-boring drill bit of FIG. 1 constructed in accordance with the present invention.

Referring also to FIG. 8, an axial end 301 of the leg 17 pressing against an axial end 303 of the slot is expected to carry most, if not all, of the normal axial load of the drilling operation. In some embodiments, the leg 17 may include a radially inwardly extending key 305 that extends into a keyway 307 in the slot 123. In this case, an upper end 309 of the key 305, pressing against the bit body 13, may carry some of the normal axial load of the drilling operation. Perhaps more importantly, however, a lower end 311 of the key 305, pressing against the bit body 13, may carry any reverse axial load experienced by the leg 17, such as from back reaming. This key 305 may also prevent the bolts 127 from carrying much, or any shear loads. In some embodiments, the key 305 may be fixedly secured to the leg 17 and may even take the form of an integral raised area, or boss, which extends into the keyway 307 in the slot 123 to accommodate such loads.

In any case, the wedge 201 of the present invention overcomes tolerance problems normally associated with module parts and assembly thereof. The wedge 201, and other aspects of the present invention, also minimize or eliminate any need to weld the leg 17 to the bit body 13, thereby further facilitating the assembly processes, while still providing secure assembly of the bit 11. Furthermore, these features substantially simplify bit repair since the few, if any, welded components may be disposed of during rework of the bit 11, as the major components are merely bolted together. For example, the welded plugs may simply be drilled out, thereby providing access to the bolts 127 to remove and/or replace the legs 17, as needed.

Other and further embodiments utilizing one or more aspects of the invention described above can be devised without departing from the spirit of the invention. Further, the various methods and embodiments of the present invention can be included in combination with each other to produce variations of the disclosed methods and embodiments. Discussion of singular elements can include plural elements and vice-versa. For example, multiple wedges 201 may be used with each leg 17.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. An earth-boring rotary tool, comprising:

a tool body having a slot at least partially defined by a first sidewall, a second sidewall opposing the first sidewall, a third sidewall extending between the first sidewall and the second sidewall, and an axial end wall of the tool body, the slot extending longitudinally parallel to a longitudinal axis defining an axial center of the tool body, wherein at least one of the first sidewall and the second sidewall is inclined toward the other in a direction extending from a base of the slot toward an opening of the slot;

at least one fixed blade associated with the tool body and configured to carry a fixed cutting element;

at least one leg configured to carry a rolling cutter, a portion of the leg disposed within the slot of the tool body and abutting the first sidewall; and a wedge disposed within the slot and pinning the leg to the tool body within the slot.

2. The earth-boring rotary tool of claim 1, wherein the leg is not welded to the tool body.

3. The earth-boring rotary tool of claim 2, further comprising at least one fastener fastening the leg to the tool body.

4. The earth-boring rotary tool of claim 2, wherein the wedge is welded to the tool body.

5. The earth-boring rotary tool of claim 2, further comprising at least one fastener fastening the wedge to the tool body.

6. The earth-boring rotary tool of claim 5, wherein the at least one fastener fastening the wedge to the tool body extends through the wedge and partially through the tool body in a direction transverse to the longitudinal axis of the tool body.

7. The earth-boring rotary tool of claim 5, wherein the fastener is welded to the wedge.

8. The earth-boring rotary tool of claim 2, wherein the slot, the leg, and the wedge are configured such that a longitudinal position of the leg relative to the tool body is adjustable by sliding the leg in the slot in a direction parallel to the longitudinal axis defining an axial center of the tool body.

9. The earth-boring rotary tool of claim 1, wherein the third sidewall is flat or curved.

10. The earth-boring rotary tool of claim 1, wherein the first sidewall is inclined toward the second sidewall at an acute angle, and wherein the second sidewall is inclined away from the first sidewall at an obtuse angle.

11. The earth-boring rotary tool of claim 10, wherein the leg has a first surface on a first sidewall thereof and a second surface on a second sidewall thereof, the first surface inclined at an acute angle toward the second surface, the second surface inclined at an acute angle toward the first surface, the first surface of the leg abutting the first sidewall of the tool body, the second surface of the leg abutting the wedge.

12. The earth-boring rotary tool of claim 11, wherein the wedge has a first surface on a first sidewall thereof and a second surface on a second sidewall thereof, the first surface of the wedge inclined at an obtuse angle away from the second surface of the wedge, the second surface of the wedge inclined at an obtuse angle away from the first surface of the wedge, the first surface of the wedge abutting the second surface of the leg, the second surface of the wedge abutting the second sidewall of the tool body.

13. The earth-boring rotary tool of claim 1, wherein an axial end of the leg abuts against the axial end wall of the tool body.

14. The earth-boring rotary tool of claim 1, wherein the leg includes a key, and the tool body includes a keyway formed in at least one of the first sidewall, the second sidewall, or the third sidewall, the key extending into the keyway.

15. The earth-boring rotary tool of claim 14, wherein the key and the keyway are located and configured such that an end of the key will abut against the tool body and carry at least some of a compressive axial load applied between the leg and the tool body during use of the earth-boring rotary tool.

16. The earth-boring rotary tool of claim 15, wherein the key and the keyway are located and configured such that another end of the key will abut against the tool body and carry at least some of a tensile axial load applied between the leg and the tool body during use of the earth-boring rotary tool.

17. The earth-boring rotary tool of claim 14, wherein the key comprises an integral portion of the leg projecting radially relative to the longitudinal axis of the tool body, and wherein the keyway comprises a recess in the at least one of the first sidewall, the second sidewall, or the third sidewall, the recess having a geometry complementary to a geometry of the integral portion of the leg projecting radially relative to the longitudinal axis of the tool body.

18. The earth-boring rotary tool of claim 1, wherein the earth-boring rotary tool is a hybrid drill bit.

19. A method of forming an earth-boring rotary tool, comprising:

forming a tool body having a slot at least partially defined by a first sidewall, an second sidewall opposing the first sidewall, a third sidewall extending between the first sidewall and the second sidewall, and an axial end wall of the tool body, the slot extending longitudinally parallel to a longitudinal axis defining an axial center of the tool body, wherein at least one of the first sidewall and the second sidewall is inclined toward the other in a direction extending from a base of the slot toward an opening of the slot, the tool body further comprising at least one fixed blade configured to carry a fixed cutting element;

forming at least one leg configured to carry a rolling cutter;

disposing a portion of the leg within the slot of the tool body and abutting a surface of the at least one leg against the first sidewall of the tool body; and disposing a wedge within the slot, the wedge pinning the leg to the tool body within the slot.

20. An earth-boring rotary tool, comprising:

a tool body having a slot at least partially defined by a first sidewall, a second sidewall opposing the first sidewall, a third sidewall extending between the first sidewall and the second sidewall, and an axial end wall of the tool body, the slot extending longitudinally parallel to a longitudinal axis defining an axial center of the tool body wherein the first sidewall is inclined toward the second sidewall at an acute angle, and wherein the second sidewall is inclined away from the first sidewall at an obtuse angle;

at least one fixed blade associated with the tool body and configured to carry a fixed cutting element;

at least one leg configured to carry a rolling cutter, a portion of the leg disposed within the slot of the tool body and abutting the first sidewall; and a wedge disposed within the slot and pinning the leg to the tool body within the slot.

* * * * *